US011320234B1

(12) United States Patent
Simon

(10) Patent No.: US 11,320,234 B1
(45) Date of Patent: May 3, 2022

(54) PISTOL GRIP PANELS AND BACKSTRAP RETENTION SYSTEM

(71) Applicant: Kimber IP, LLC, Troy, AL (US)

(72) Inventor: John B. Simon, Troy, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 17/229,208

(22) Filed: Apr. 13, 2021

(51) Int. Cl.
*F41C 23/10* (2006.01)
*F41A 17/20* (2006.01)
*F41A 3/66* (2006.01)

(52) U.S. Cl.
CPC ..... *F41C 23/10* (2013.01); *F41A 3/66* (2013.01); *F41A 17/20* (2013.01)

(58) Field of Classification Search
CPC .. F41C 23/10; F41C 23/16; F41A 3/66; F41A 11/00
See application file for complete search history.

(56) References Cited

U.S. PATENT DOCUMENTS 984,519 A 2/1911 Browning
9,777,984 B1 * 10/2017 Bonine ..... F41C 23/10
10,054,391 B1 * 8/2018 Lyman ..... F41A 3/66
10,731,936 B1 8/2020 Sapio et al.
2017/0030677 A1 * 2/2017 Faifer ..... F41C 23/10
2018/0266778 A1 * 9/2018 Noonan ..... F41A 19/10

* cited by examiner

*Primary Examiner* — J. Woodrow Eldred
(74) *Attorney, Agent, or Firm* — Kaplan Breyer Schwarz, LLP

(57) ABSTRACT

A firearm having a grip panels and backstrap retention system is provided. A latch plate is disposed adjacent to the backstrap side of the frame having a pair of side edges having rearward facing protuberances thereon and is moveable perpendicular to the magazine well axis from an engagement position towards the trigger side of the frame to a disengagement position towards the backstrap side of the frame. A latch plate spring biases the latch plate to the disengagement position. Each grip panel has a forward grip undercut to receive corresponding forward frame undercuts. Each forward grip undercut engages the corresponding forward frame undercut by seating each grip panel in its grip offset surface and translating each grip panel toward the trigger side of the frame. Each grip panel further has a rearward grip undercut facing the frame to receive a corresponding undercut latch plate protuberance. When the latch plate is in the engagement position, the latch plate protuberances engage the rearward grip undercuts.

8 Claims, 11 Drawing Sheets

PISTOL GRIP PANELS AND BACKSTRAP RETENTION SYSTEM

BACKGROUND OF THE INVENTION

This invention is directed to firearm grips and backstraps. More particularly, this invention is directed to firearm handgun-style grips and backstraps that are removable and replaceable.

Grips for firearms such as handguns and other pistols have been in use essentially since firearms were invented. Firearms having removable and therefore interchangeable grips have also likely been available for nearly as long. See, for example, the patent for the original 1911-style pistol (U.S. Pat. No. 984,519 (Browning) which shows the commonly seen screw-on style grips where separate grip panels are secured to the pistol frame by pairs of screws visible on the outer surfaces of the grip panels.

However, in many circumstances, it would be desirable to eliminate the visible and often unsightly screw heads or other external fasteners used to secure the grip panels to the frame for handguns and other firearms. Additionally, a firearm without such screws eliminates the possibility of the screws loosening through use and recoil vibration. Such a design would offer improved aesthetics for firearms, and provide for interchangeability of grips to, for example, reduce or increase grip thickness and/or overall firearm width, allow a user to purchase alternative grip options either from the original handgun manufacturer, or the aftermarket, to obtain desired grip color, texture, profile, material, and the like.

Doing so with a 1911-style pistol poses challenges to alternate methods of grip attachment due to the configuration and placement of the mainspring, mainspring housing, hammer strut, and grip safety (or backstrap if no pivoting grip safety feature is present) all located at the rear of the pistol grip. The present invention is directed to addressing these challenges.

All references cited herein are incorporated herein by reference in their entireties.

SUMMARY OF THE INVENTION

A firearm having a pistol grip panels and backstrap retention system is provided. The system includes a firearm frame to receive a pair of grip panels, a backstrap, and a mainspring housing. The frame includes a handle portion having a left side, a right side, a backstrap side, a trigger side, a bottom side, and a magazine well having a magazine well axis. The left side and the right side each having a grip offset surface to receive one of the pair of grip panels. The frame has a pair of tracks to receive the mainspring housing by sliding the mainspring housing in the frame from the bottom side parallel to the magazine well axis in the typical of 1911-style firearms. A latch plate is disposed adjacent to the backstrap side of the frame, the latch plate having a pair of side edges having rearward facing protuberances thereon. The latch plate is moveable perpendicular to the magazine well axis from an engagement position towards the trigger side of the handle portion of the frame to a disengagement position towards the backstrap side of the handle portion of the frame. A latch plate spring biases the latch plate to the disengagement position. Each grip panel has an outer side and a frame side. The frame side has a forward grip undercut facing the trigger side of the frame. The forward grip undercut receives a corresponding forward frame undercut disposed on each of the left side and the right side of the handle portion of the frame. Each forward grip undercut engages the corresponding forward frame undercut by seating each grip panel in its grip offset surface and translating each grip panel toward the trigger side of the handle portion of the frame. The frame side of each grip panel further has a rearward grip undercut. Each rearward grip undercut faces the trigger side of the pistol portion of the frame and receives a corresponding undercut latch plate protuberance. When the latch plate is in the engagement position, the latch plate protuberances engage the rearward grip undercuts. Each grip panel is inserted into its corresponding grip offset surface in the frame and translated forward, the mainspring housing is inserted into the tracks in the frame, causing the latch plate to translate from the disengagement position to the engagement position to secure the grip panels and backstrap to the handle portion of the frame.

The mainspring housing may be locked into position by a detent pin disposed through the grip panels and a frame aperture that extends between the left side and the right side of the frame. The mainspring housing may have a top side having a protuberance for receipt in a bottom side of the backstrap. One of the forward grip undercuts may be a protuberance and one of the forward frame undercuts may be a mating aperture in the frame. The backstrap may be a pivoting 1911-style safety. Each of the left side and the right side of the handle portion of the frame may have a frame pin for receipt in a frame pin aperture in each grip panel. Each frame pin may have a gasket thereon, for example, an O-Ring.

A firearm having a pistol grip panels and backstrap retention system is provided. The system includes a firearm frame to receive a pair of grip panels, a backstrap (or grip safety), and a mainspring housing. The frame includes a handle portion having a left side, a right side, a backstrap side, a trigger side, a bottom side and a magazine well having a magazine well axis. The left side and the right side of the frame each have a grip offset surface to receive one of the pair of grip panels. The frame has a pair of tracks to receive the mainspring housing by sliding the mainspring housing in the frame from the bottom side parallel to the magazine well axis. A latch plate is disposed adjacent to the backstrap side of the frame, moveable perpendicular to the magazine well axis from an engagement position to a disengagement position. A latch plate spring biases the latch plate to the disengagement position. Each grip panel has an outer side and a frame side, where the frame side has a pair of forward grip undercuts, facing the trigger side of the frame. The forward grip undercuts receive a corresponding pair of forward frame undercuts disposed on each of the left side and the right side of the handle portion of the frame. The forward grip undercuts engage the forward frame undercuts by seating each grip panel in its grip offset surface and translating each grip panel toward the trigger side of the handle portion of the frame.

For the purposes of the present invention, the terms "parallel" and "perpendicular" as used throughout the present specification and claims are intended to mean approximately or generally parallel or perpendicular. That is, each of these terms is intended to include a range of angles beyond precisely parallel or precisely perpendicular, for example, +/−10 degrees or more, so long as the system operates in the intended manner, as described herein The frame side of each grip panel further has a pair of rearward grip undercuts facing the backstrap side of the frame. The forward grip undercuts receive a corresponding pair of latch plate undercuts, wherein, when the latch plate is in the engagement position, the latch plate undercuts engage the rearward grip undercuts.

Each grip panel is inserted into its corresponding grip offset surface in the frame and translated forward and the mainspring housing is inserted into the tracks in the frame, causing the latch plate to translate from the disengagement position to the engagement position to secure the grip panels and backstrap to the handle portion of the frame.

The mainspring housing may be locked into position by a detent pin disposed through the grip panels and a frame aperture that extends between the left side and the right side of the frame. Each of the grip offset surfaces may have a protuberance and each of the frame sides of the grip panels may have an aperture to receive the protuberance. The mainspring housing may have a top side having a protuberance for receipt in a bottom side of the backstrap. One of the forward grip undercuts may be a protuberance and one of the forward frame undercuts is a mating aperture in the frame. Alternatively, one of the forward grip undercuts is an aperture and one of the forward frame undercuts is a mating protuberance in the frame. The protuberance on each grip panel may have a gasket installed thereon that mates with its mating aperture in the frame. The gasket is, for example, an O-ring.

DETAILED DESCRIPTION

Figure 1:
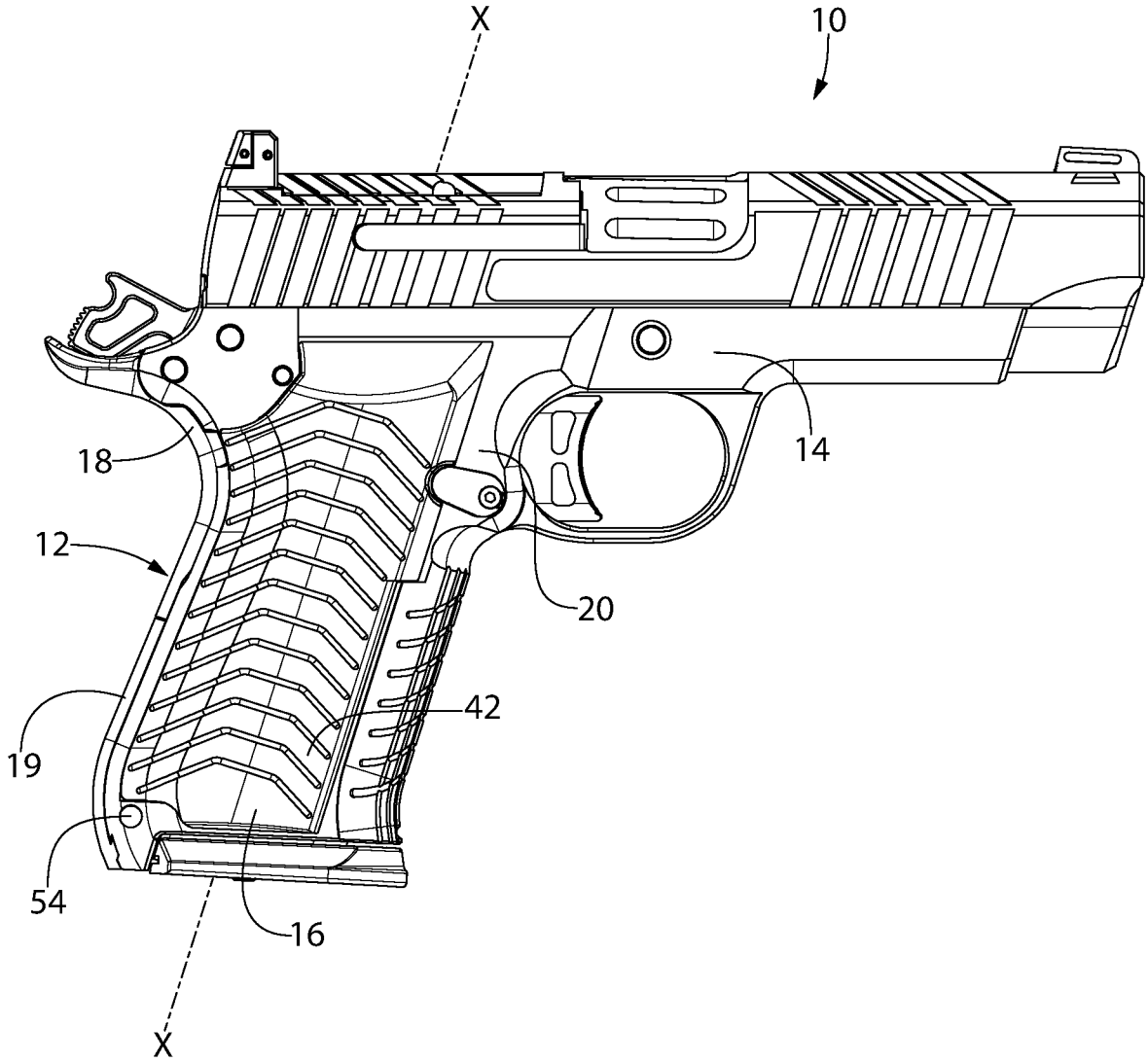
FIG. 1 is a right side elevation view of a firearm having a pistol grip panels and backstrap retention system in accordance with an exemplary embodiment of the present invention.

Referring now to the drawing figures wherein like reference number refer to like elements throughout the several views, there is shown in FIGS. 1-11 a firearm 10 having a pistol grip panels and backstrap retention system 12 in accordance with an exemplary embodiment of the present invention. The firearm 10 includes a frame 14 to receive a pair of grip panels 16, a backstrap 18, and a mainspring housing 19. The frame 14 includes a handle portion 20 having a left side 22, a right side 24, a backstrap side 26, a trigger side 28, a bottom side 30 and a magazine well 32 (having magazine well axis X). The left side 22 and the right side 24 each have a grip offset surface 34 to receive one of the pair of grip panels 16. The frame 14 has a pair of tracks 36 to receive the mainspring housing 19 by sliding the mainspring housing 19 into the frame 12 from the bottom side 30 parallel to the magazine well axis X.

Figure 11:
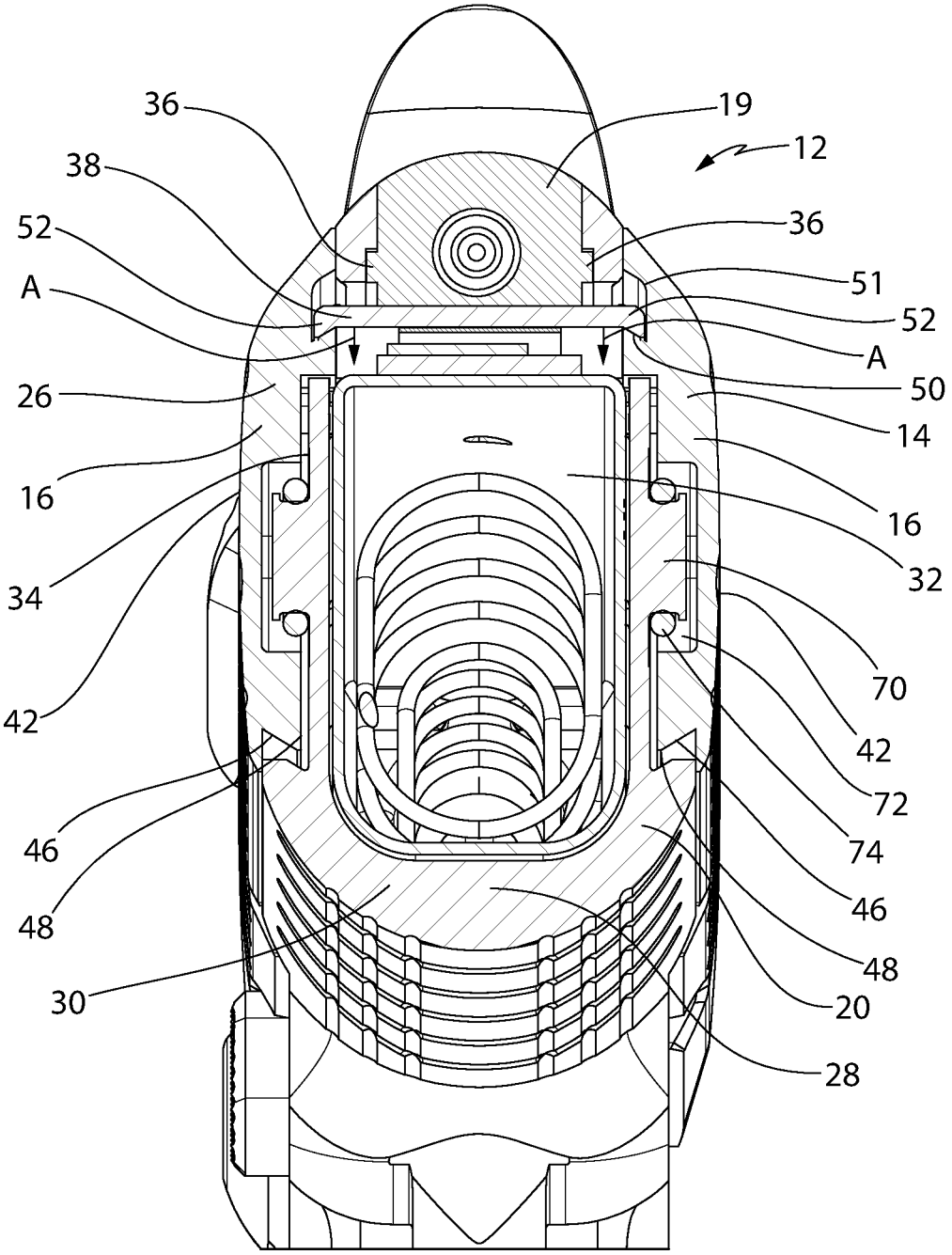
FIG. 11 is a cross-sectional view of a firearm having the pistol grip panels and backstrap retention system of FIG. 1, take along lines 11-11 of FIG. 10, shown with its mainspring housing in a fully installed configuration.

A latch plate 38 is disposed adjacent to the backstrap side 26 of the frame 14 and is moveable in direction A (see FIGS. 7 and 11) perpendicular to the magazine well axis X from a disengagement position (See FIG. 7) to an engagement position (see FIG. 11). A latch plate spring 40 biases the latch plate 38 to the disengagement position, i.e., in direction B (see FIG. 9) (opposite to direction A (see FIG. 11), in a direction generally perpendicular to the magazine well axis X (see FIGS. 1 and 9) from the trigger side 28 to the backstrap side 26 of the frame 14.

Each grip panel 16 has an outer side 42 and a frame side 44. The frame side 44 has a pair of forward grip undercuts 46 that face the trigger side 28 of the frame 14. The forward grip undercuts 46 receive a corresponding pair of forward frame undercuts 48 disposed on each of the left side 22 and the right side 24 of the handle portion 20 of the frame 14. The forward grip undercuts 46 engage the forward frame undercuts 48 by seating each grip panel 16 in its grip offset surface 34 and translating each grip panel 16 toward the trigger side 28 of the handle portion 20 of the frame 14.

Figure 2:
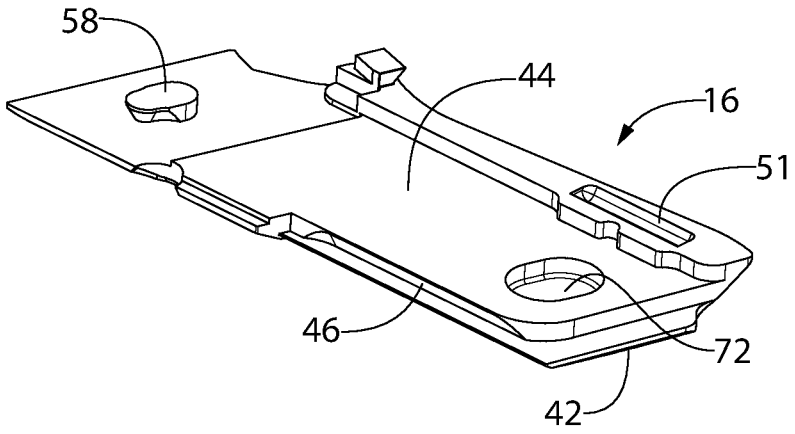
FIG. 2 is a rear isometric view of a right-side grip panel of a firearm having the pistol grip panels and backstrap retention system of FIG. 1.
Figure 3:
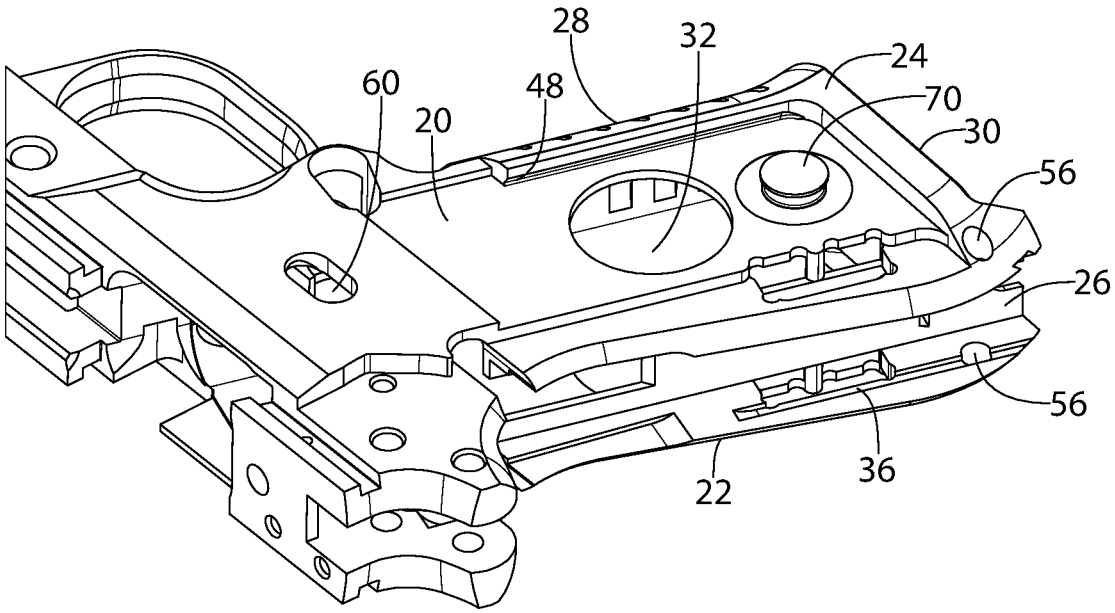
FIG. 3 is a right side isometric view of a frame for a firearm having the pistol grip panels and backstrap retention system of FIG. 1.
Figure 4:
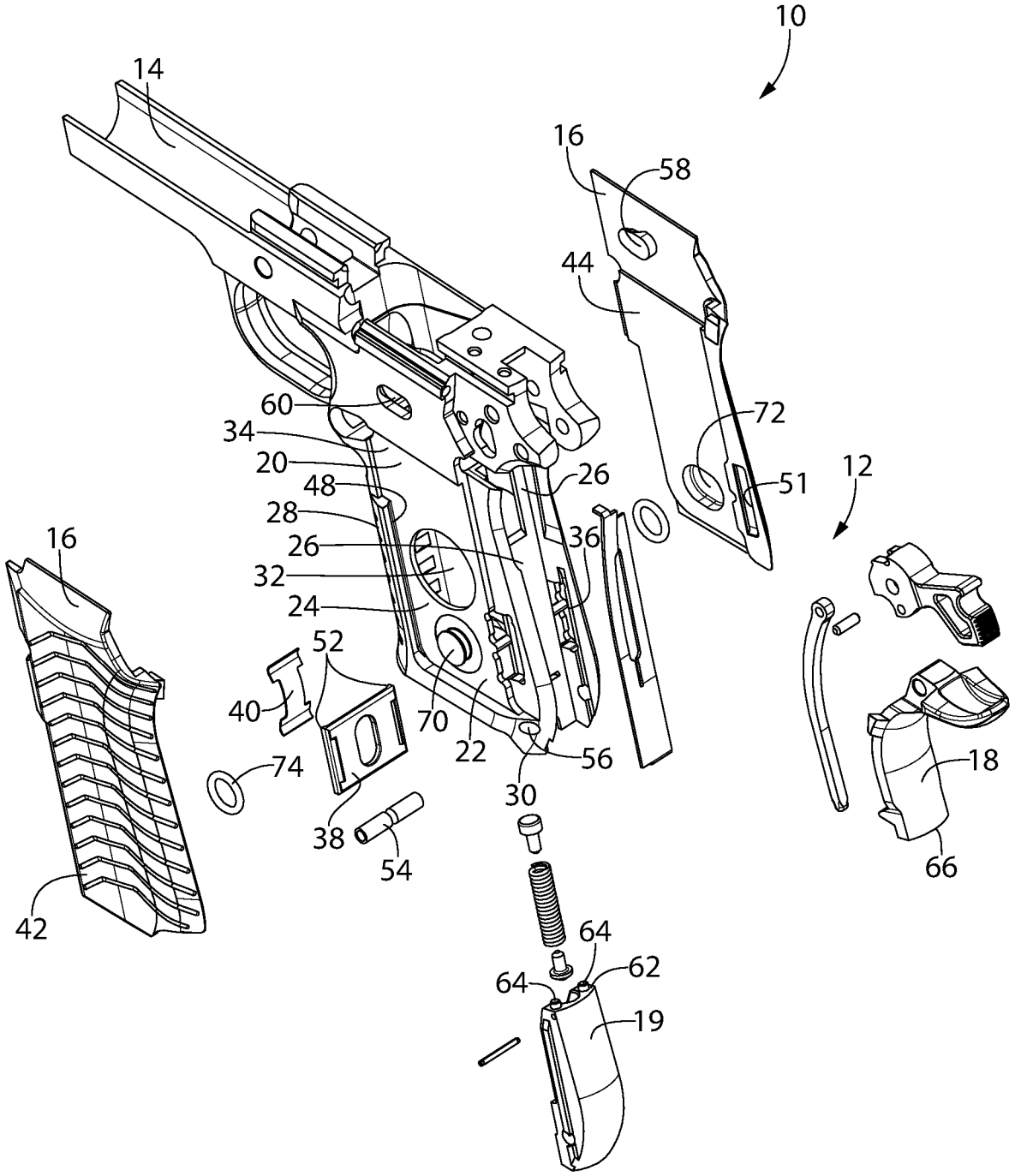
FIG. 4 is an exploded isometric view of the firearm having the pistol grip panels and backstrap retention system of FIG. 1.
Figure 6:
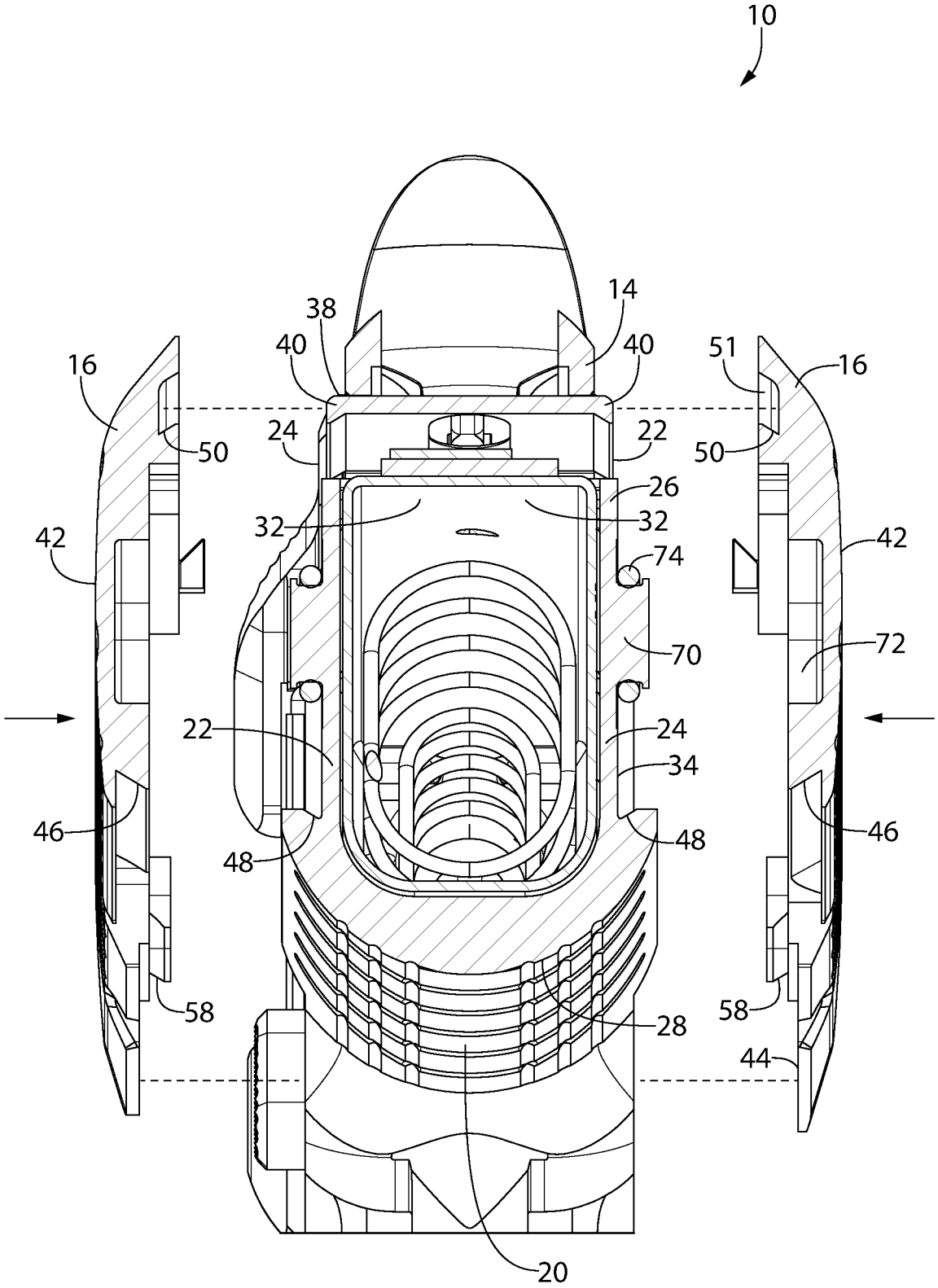
FIG. 6 is a cross-sectional view of a firearm having the pistol grip panels and backstrap retention system of FIG. 1, take along lines 6-6 of FIG. 5, shown with its grip panels in an exploded configuration.
Figure 7:
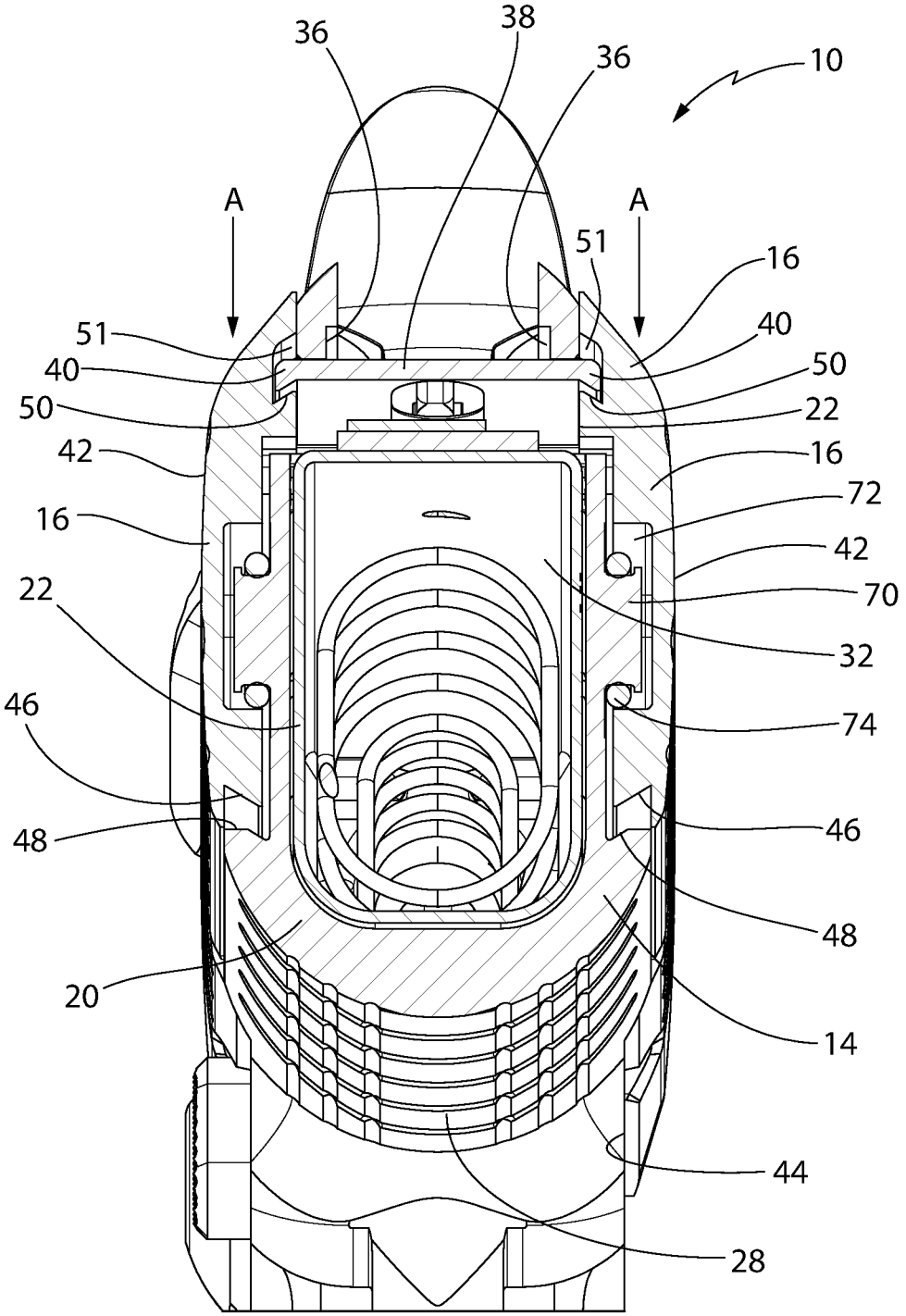
FIG. 7 is a cross-sectional view of a firearm having the pistol grip panels and backstrap retention system of FIG. 1, take along lines 6-6 of FIG. 5, shown with its grip panels in a partially installed configuration.
Figure 8:
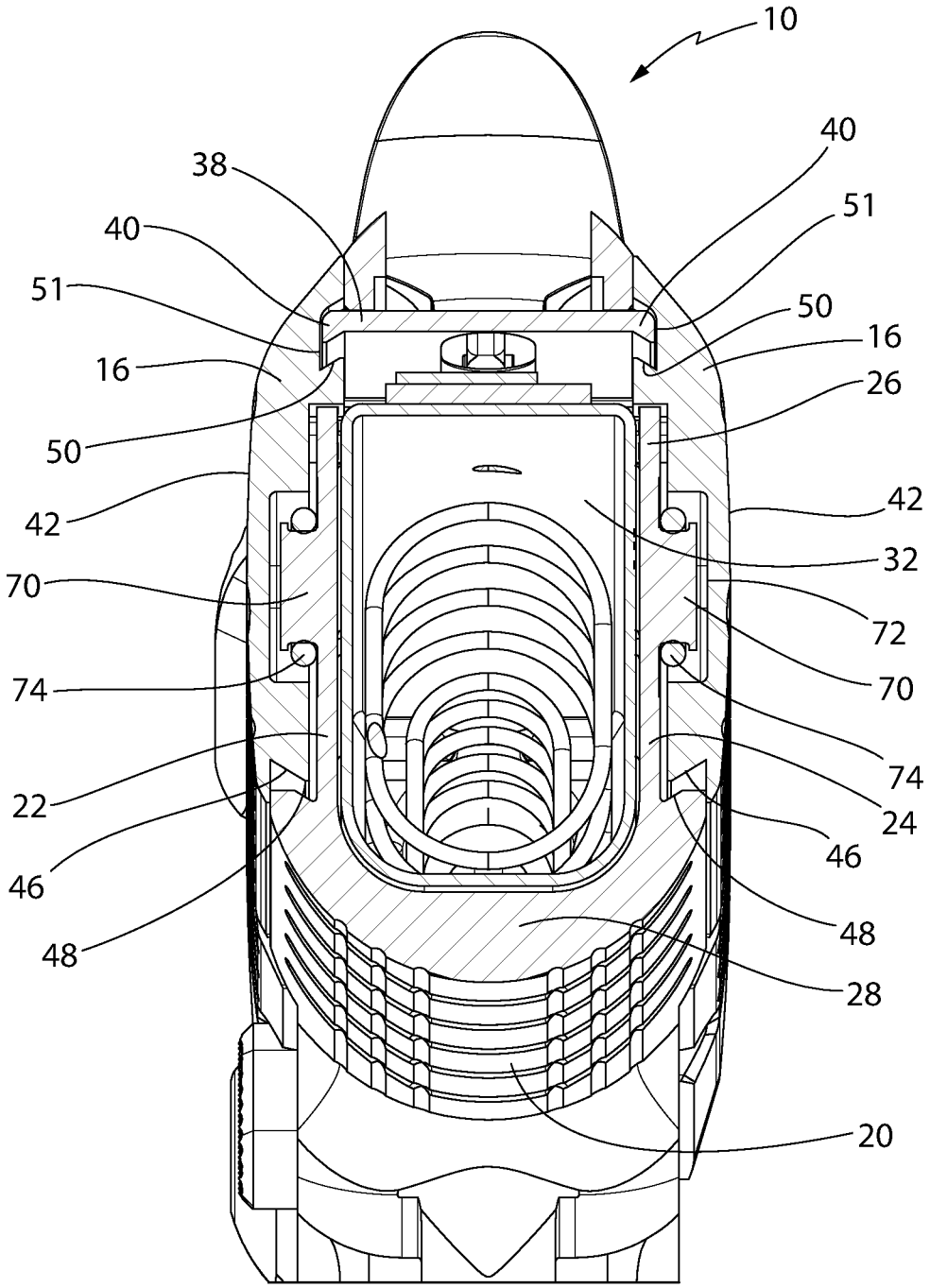
FIG. 8 is a cross-sectional view of a firearm having the pistol grip panels and backstrap retention system of FIG. 1, take along lines 6-6 of FIG. 5, shown with its grip panels in a fully installed configuration.
Figure 9:
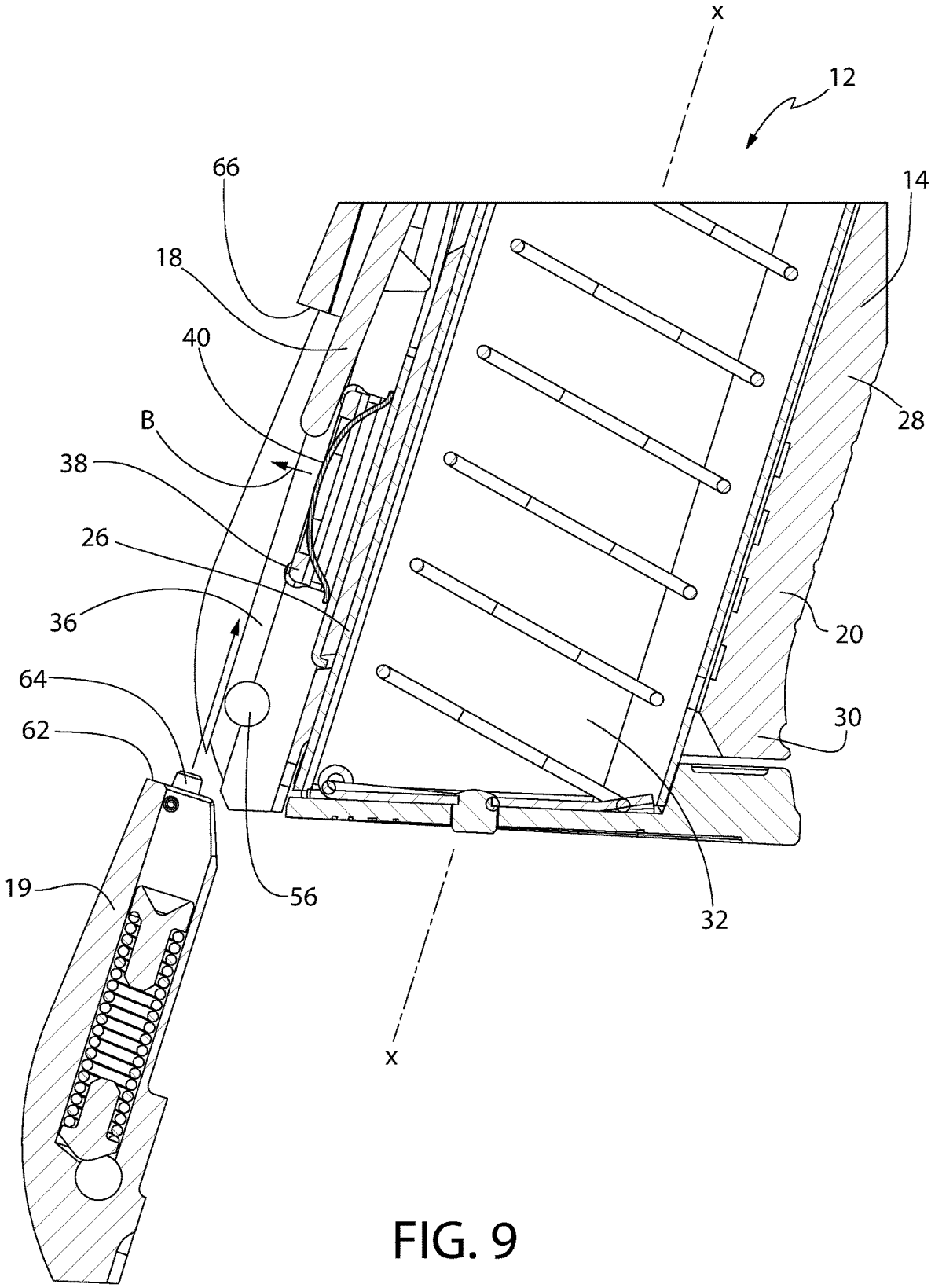
FIG. 9 is a partial, cross-sectional view of a firearm having the pistol grip panels and backstrap retention system of FIG. 1, take along lines 9-9 of FIG. 5, shown with its mainspring housing in an exploded configuration, prior to installation.
Figure 10:
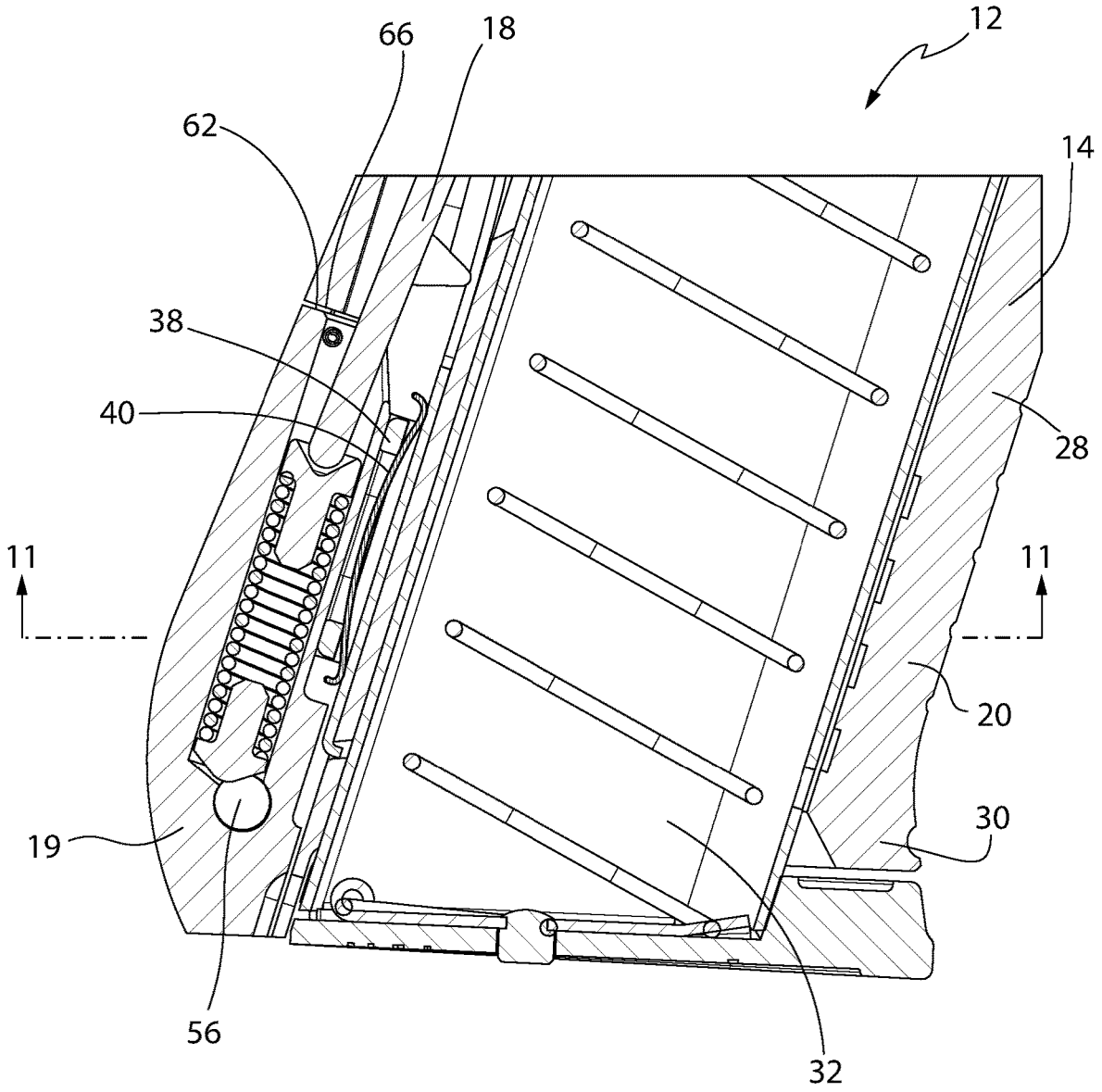
FIG. 10 is a partial, cross-sectional view of a firearm having the pistol grip panels and backstrap retention system of FIG. 1, take along lines 9-9 of FIG. 5, shown with its mainspring housing in a fully installed configuration.
Figure 12:
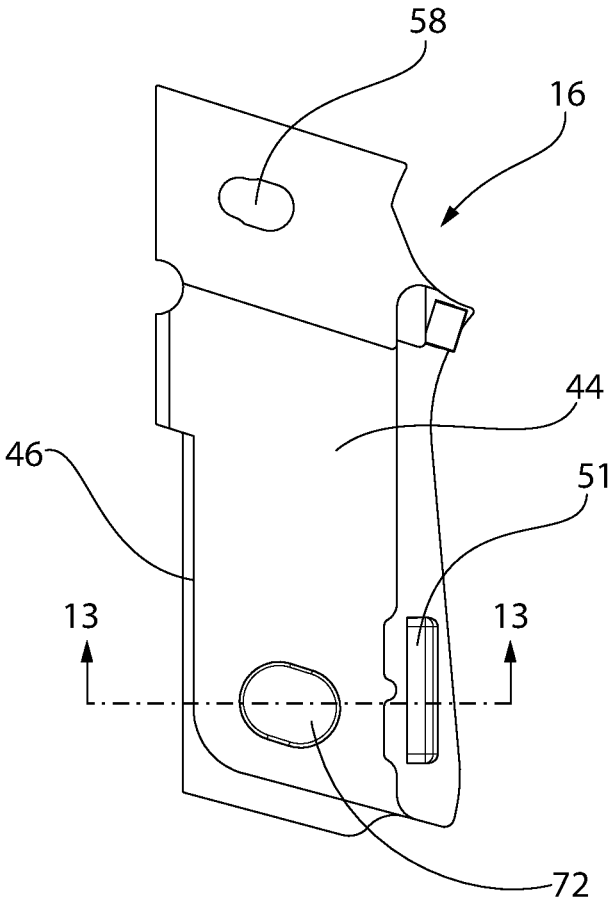
FIG. 12 is a left side elevation view of a right side grip panel of the firearm having the pistol grip panels and backstrap retention system of FIG. 1.
Figure 13:
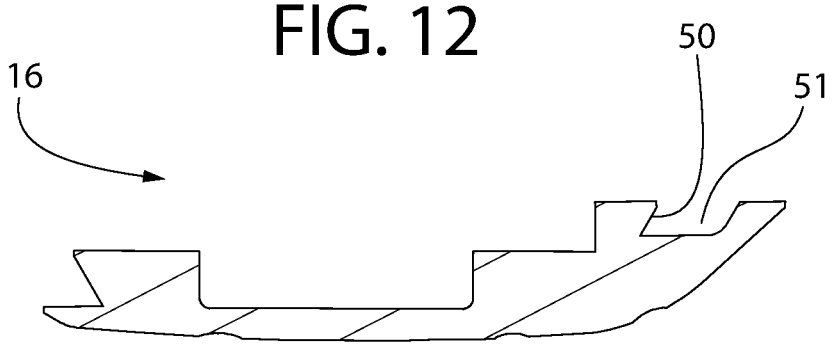
FIG. 13 is a cross-sectional view of the right side grip panel of FIG. 12, taken along lines 13-13 of FIG. 12.

The frame side 44 of each grip panel 16 has a rearward grip undercut 50 facing the trigger side 28 of the frame 14, the undercut 50 preferably disposed in an aperture 51 (see FIGS. 2, 6 and 13). The rearward grip undercut 50 receives a corresponding latch plate protuberance 51. When the latch plate 38 is in the engagement position of FIG. 11, undercut latch plate protuberances 52 engage the rearward grip undercuts 50. See FIGS. 12 and 13.

Each grip panel 16 is inserted into its corresponding grip offset surface 34 in the frame 14 and translated forward and the mainspring housing 19 is inserted into the tracks 36 in the frame 14. The mainspring housing 19 causes the latch plate 38 to translate in direction A (see FIGS. 7 and 11) from the disengagement position (FIG. 8) to the engagement position (FIG. 11) to secure the grip panels 16 and backstrap 18 to the handle portion 20 of the frame 14.

Figure 5:
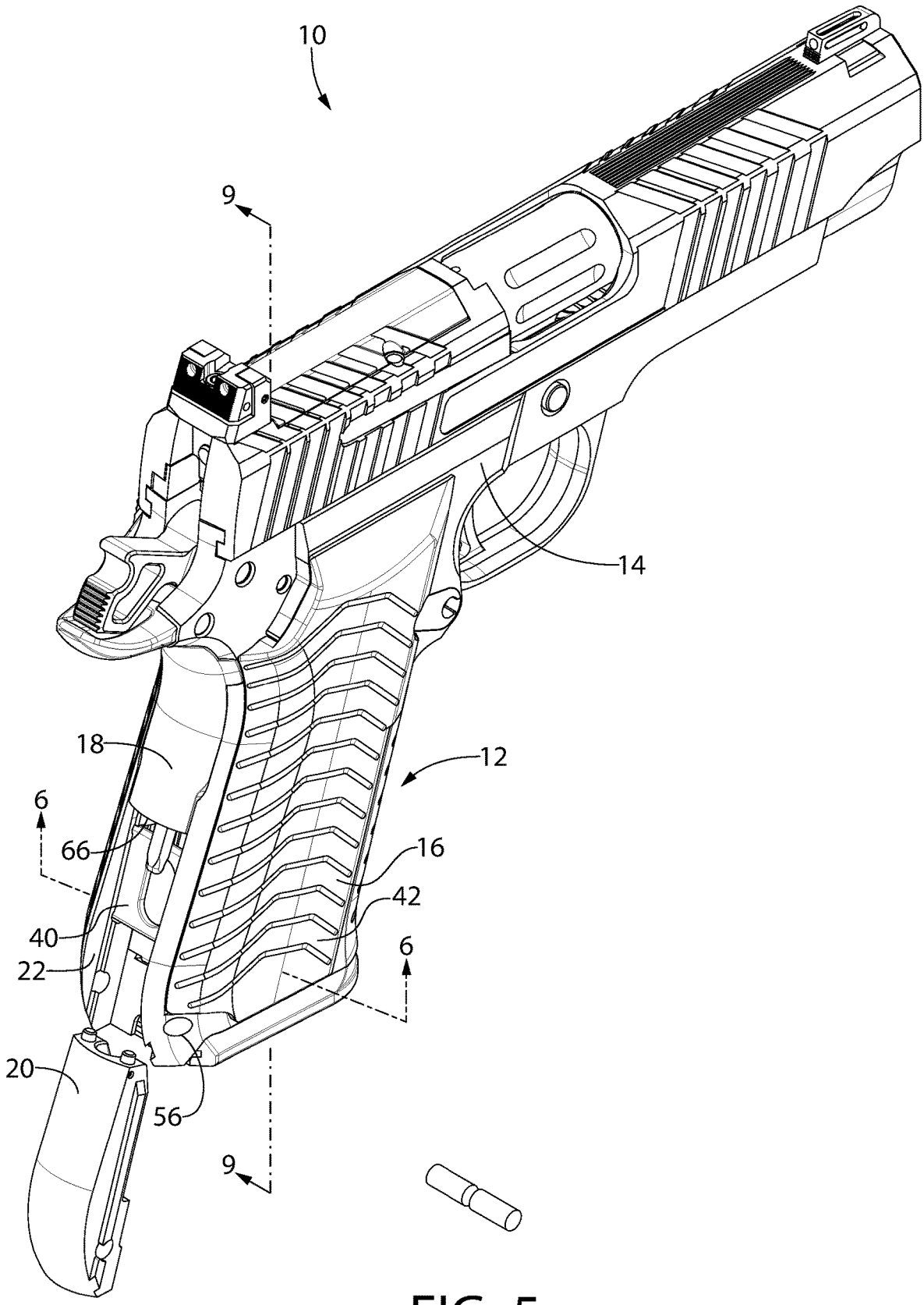
FIG. 5 is a right side isometric view of a firearm having the pistol grip panels and backstrap retention system of FIG. 1, shown with its mainspring housing and retention pin in an exploded configuration.

As shown in FIG. 5, the mainspring housing 19 may be locked into position by a detent pin 54 disposed through the grip panels 16 and a frame aperture 56 that extends between the left side 22 and the right side 24 of the handle portion 20 of the frame 14. Each of the grip offset surfaces 34 may have a protuberance 58 and each of the frame sides 44 of the grip panels 16 may have an aperture 60 to receive the protuberance 58. See FIGS. 2-4. The mainspring housing 19 may have a top side 62 having a protuberance(s) 64 for receipt in a bottom side 66 of the backstrap 18 to secure the backstrap 18, grip panels 16, and mainspring housing 19 to the frame.

A frame pin 70 on the handle portion 20 of the frame on each of the left side 22 and the right side 24 may engage a frame pin aperture 74 in each grip panel 16 to further secure the grip panels 16. A gasket 74 may be installed on each frame pin 70 to provide a modest interference fit. The gasket is, for example, an elastomeric O-ring.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A firearm having a pistol grip panels and backstrap retention system, comprising:

(a) a firearm frame to receive a pair of grip panels, a backstrap, and a mainspring housing, the frame comprising a handle portion, the handle portion having a left side, a right side, a backstrap side, a trigger side, a bottom side and a magazine well having a magazine well axis, the left side and the right side each having a grip offset surface to receive one of the pair of grip panels, the frame having a pair of tracks to receive the mainspring housing by sliding the mainspring housing in the frame from the bottom side parallel to the magazine well axis;

(b) a latch plate disposed adjacent to the backstrap side of the frame, the latch plate having a pair of side edges having rearward facing protuberances thereon, the latch plate moveable perpendicular to the magazine well axis from an engagement position towards the trigger side of the handle portion of the frame to a disengagement position towards the backstrap side of the handle portion of the frame;

(c) a latch plate spring to bias the latch plate to the disengagement position;

(d) each grip panel having an outer side and a frame side, the frame side having a forward grip undercut, the forward grip undercuts facing the trigger side of the frame, the forward grip undercut to receive a corresponding forward frame undercut disposed on each of the left side and the right side of the handle portion, wherein each forward grip undercut engages the corresponding forward frame undercut by seating each grip panel in its grip offset surface and translating each grip panel toward the trigger side of the handle portion of the frame; and (e) the frame side of each grip panel further having a rearward grip undercut, each rearward grip undercut facing the trigger side of the pistol portion of the frame, each rearward grip undercut to receive a corresponding undercut latch plate protuberance, wherein, when the latch plate is in the engagement position, the latch plate protuberances engage the rearward grip undercuts;

wherein, each grip panel is inserted into its corresponding grip offset surface in the frame and translated forward, the mainspring housing is inserted into the tracks in the frame, causing the latch plate to translate from the disengagement position to the engagement position to secure the grip panels and backstrap to the handle portion of the frame.

2. The firearm having a pistol grip panels and backstrap retention system of claim 1, wherein the mainspring housing is locked into position by a detent pin disposed through the grip panels and a frame aperture that extends between the left side and the right side of the frame.

3. The firearm having a pistol grip panels and backstrap retention system of claim 1, wherein the mainspring housing has a top side having a protuberance for receipt in a bottom side of the backstrap.

4. The firearm having a pistol grip panels and backstrap retention system of claim 1, wherein one of the forward grip undercuts is a protuberance and one of the forward frame undercuts is a mating aperture in the frame.

5. The firearm having a pistol grip panels and backstrap retention system of claim 1, wherein the backstrap is a pivoting 1911-style safety.

6. The firearm having a pistol grip panels and backstrap retention system of claim 1, wherein each of the left side and the right side of the handle portion of the frame has a frame pin for receipt in a frame pin aperture in each grip panel.

7. The firearm having a pistol grip panels and backstrap retention system of claim 6, wherein each frame pin has a gasket thereon.

8. The firearm having a pistol grip panels and backstrap retention system of claim 7, wherein the gasket is an O-ring.

* * * * *